US008059852B2

(12) United States Patent
Cheng

(10) Patent No.: US 8,059,852 B2
(45) Date of Patent: Nov. 15, 2011

(54) ELECTRONIC DEVICE WITH EARPHONE

(75) Inventor: Che-Hsiung Cheng, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 462 days.

(21) Appl. No.: 12/389,496

(22) Filed: Feb. 20, 2009

(65) Prior Publication Data

US 2010/0142745 A1 Jun. 10, 2010

(30) Foreign Application Priority Data

Dec. 9, 2008 (CN) ..... 2008 1 0306064

(51) Int. Cl.
*H04R 25/00* (2006.01)

(52) U.S. Cl. ..... 381/384; 381/370; 379/438; 242/166; 242/167; 242/170; 242/171

(58) Field of Classification Search ..... 381/370, 381/374, 383, 384; 379/438; 242/166, 167, 242/170, 171
See application file for complete search history.

(56) References Cited

U.S. PATENT DOCUMENTS

| | | | | | |
|---|---|---|---|---|---|
| 4,754,484 | A * | 6/1988 | Larkin et al. | 379/430 |
| 4,942,617 | A * | 7/1990 | Boylan | 381/182 |
| 5,177,784 | A * | 1/1993 | Hu et al. | 379/430 |
| 5,706,353 | A * | 1/1998 | Arai et al. | 381/77 |
| 5,724,667 | A * | 3/1998 | Furuno | 455/575.2 |
| 6,438,248 | B1 * | 8/2002 | Kamimura et al. | 381/374 |
| 6,542,757 | B2 * | 4/2003 | Bae | 455/575.2 |
| 6,698,560 | B2 * | 3/2004 | Reardon et al. | 191/12 R |
| 7,086,512 | B2 * | 8/2006 | Shack et al. | 191/12.4 |
| 7,801,322 | B2 * | 9/2010 | Chiu | 381/384 |
| 2003/0096640 | A1 * | 5/2003 | Bae | 455/568 |
| 2003/0157973 | A1 * | 8/2003 | Yang | 455/569 |
| 2003/0165237 | A1 * | 9/2003 | Farr et al. | 379/430 |
| 2008/0159579 | A1 * | 7/2008 | Park | 381/370 |
| 2011/0026754 | A1 * | 2/2011 | Li et al. | 381/374 |
| 2011/0170732 | A1 * | 7/2011 | Parker et al. | 381/384 |

* cited by examiner

*Primary Examiner* — Ngan Ngo

(74) *Attorney, Agent, or Firm* — Altis Law Group, Inc.

(57) ABSTRACT

An electronic device includes a housing, a printed circuit board mounted within the housing, an earphone and a cable storing compartment. The earphone includes a connecting cable and a head member. One end of the connecting cable is connected to the printed circuit board, the other end is connected to the head member. The cable storing compartment includes a recessed portion and an earphone compartment. The recessed portion is defined in a peripheral wall of the housing. The earphone compartment is defined in the peripheral wall and adjacent to the recessed portion. The recessed portion receives the connecting cable. The earphone compartment receives the head member.

2 Claims, 2 Drawing Sheets

ELECTRONIC DEVICE WITH EARPHONE

BACKGROUND

1. Technical Field

The present disclosure relates to an electronic device and, particularly, to an electronic device incorporating an earphone.

2. Description of related art

Usually, earphones are used to listen to music stored in portable electronic devices (e.g., MP3 players). However, the earphone typically has a long connecting cable and the connecting cable can easily get tangled. In addition, when the earphone is detached from the electronic device, the earphone may be easily lost or misplaced.

Therefore, there is room for improvement within the art.

BRIEF DESCRIPTION OF THE DRAWINGS

Many aspects of the electronic device can be better understood with reference to the following drawings. These drawings are not necessarily drawn to scale, the emphasis instead being placed upon clearly illustrating the principles of the present electronic device. Moreover, in the drawings like reference numerals designate corresponding sections throughout the several views.

DETAILED DESCRIPTION OF EXEMPLARY EMBODIMENT

Figure 1:
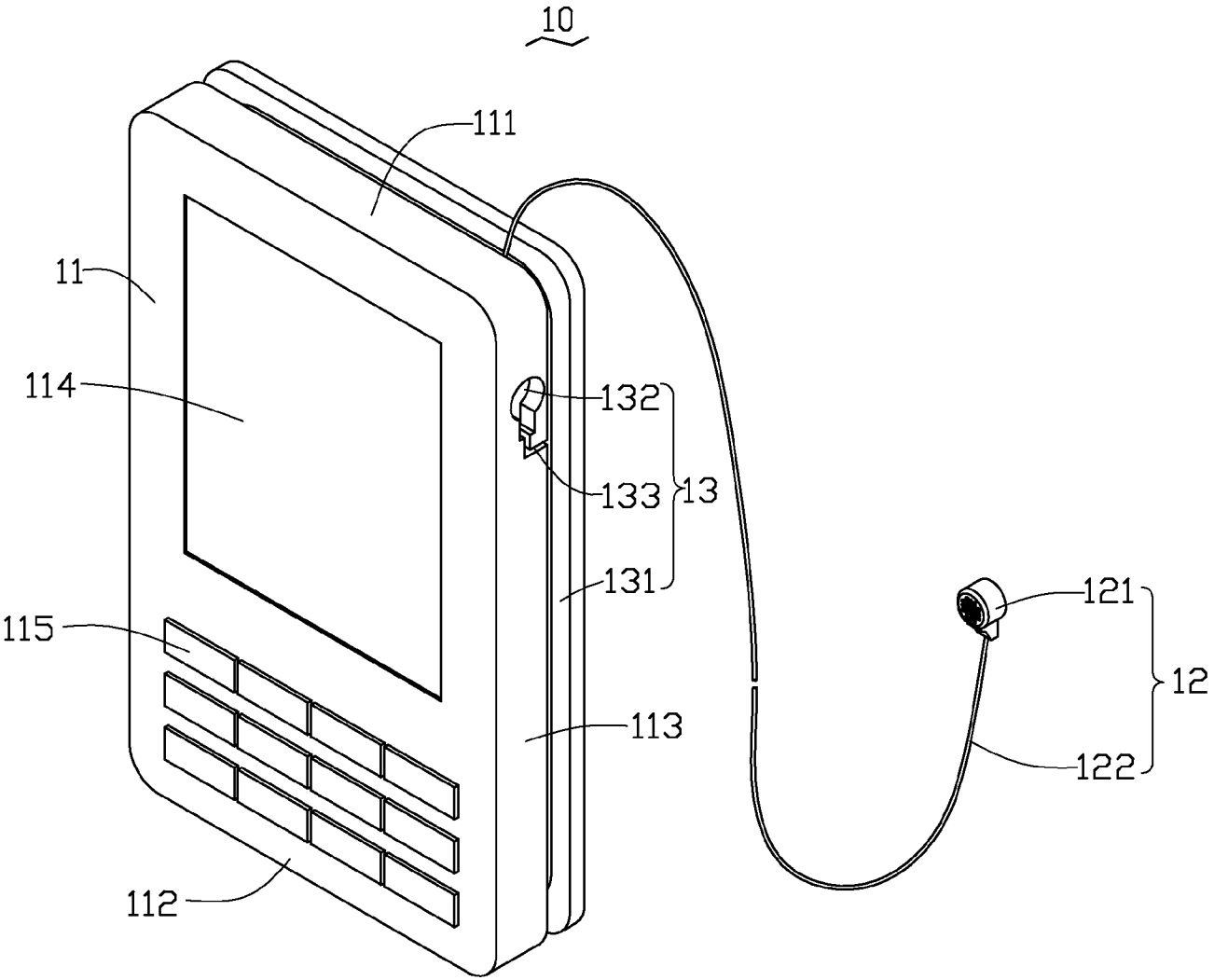
FIG. 1 is an isometric view of an electronic device in use, according to an exemplary embodiment.
Figure 2:
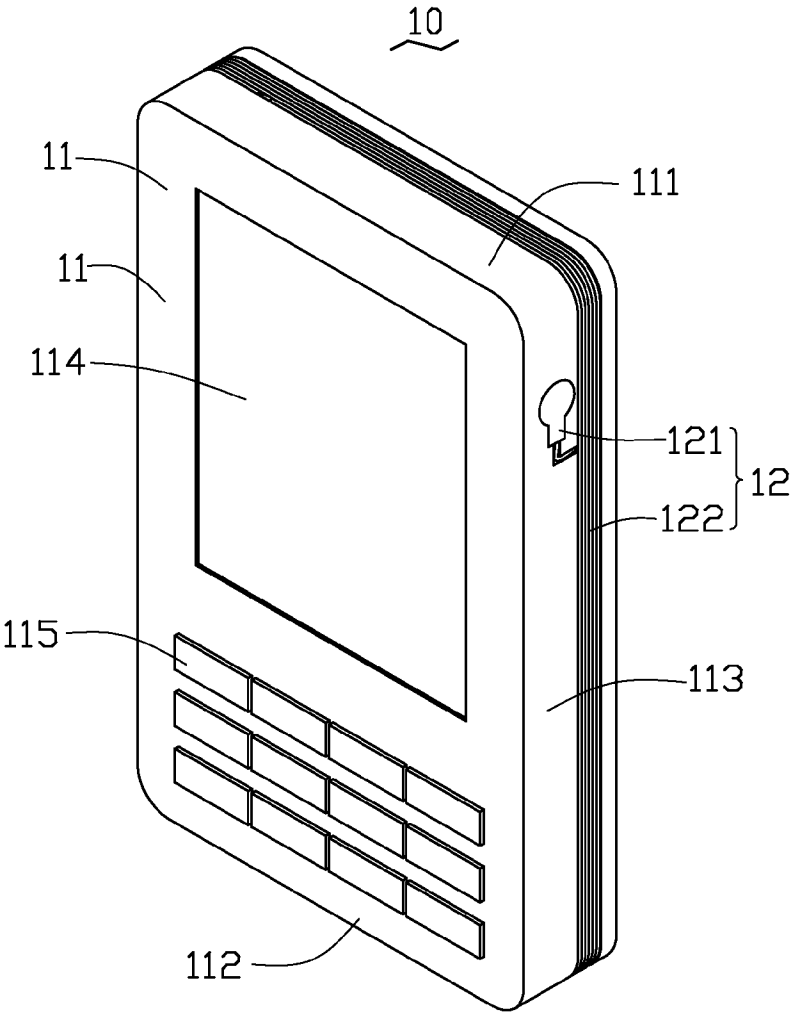
FIG. 2 is another isometric view of the electronic device, shown in FIG. 1.

FIGS. 1 and 2 show an exemplary electronic device 10 including a housing 11, a printed circuit board (PCB) (not shown), an earphone 12, and a cable storing compartment 13. The earphone 12 is electrically connected to the PCB. The cable storing compartment 13 is defined in the housing 11.

The housing 11 includes a top portion 111, a bottom portion 112, and a peripheral wall 113 having a recessed portion 131. The housing 11 includes a screen 114 adjacent to the top portion 111 and a plurality of keys 115 adjacent to the bottom portion 112.

The earphone 12 includes a head member 121 and a connecting cable 122. The connecting cable 122 is configured to coil about (i.e., be wound around) the recessed portion 131 of the peripheral wall 113 with one end connected to the PCB and the other end connected to the head member 121.

The cable storing compartment 13 includes the recessed portion 131 and an earphone compartment 132. The recessed portion 131 and earphone compartment 132 are defined in the peripheral wall 113 adjacent to each other. The recessed portion 131 communicates with the earphone compartment 132 through a connecting slot 133. A bottom wall of the recessed portion 131 defines a hole (not shown). The connecting cable 122 can be electrically connected to the PCB through the hole.

When not in use, the connecting cable 122 is wound about the peripheral wall 113 of the housing 11 and received in the recessed portion 131, and the head member 121 is configured to latch into the earphone compartment 132.

To use the earphone 12 e.g., listen to music, the head member 121 is released from the earphone compartment 132. At this stage, the user can easily detach (i.e., unwind) the connecting cable 122 from the housing 11 and put the head member 121 of the earphone 12 into his/her ear for listening to music.

The electronic device 10 incorporates the earphone 12 in the housing 11, ensuring comparatively easy use without risk of entanglement or loss.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of sections within the principles of the invention to the full extent indicated by the broad general meaning of the terms, in which the appended claims are expressed.

What is claimed is:

1. An electronic device, comprising:

a housing including peripheral sidewalls connecting with each other to form the outer perimeter of the housing, a continuous recessed portion defined in all the peripheral sidewalls, an earphone compartment defined in one of the peripheral sidewalls and adjacent to the recessed portion;

an earphone including a connecting cable and a head member, one end of the connecting cable being connected to the inside of the housing, portions of the connecting cable being repeatedly winded around the outer perimeter of the housing inside the recessed portion, the other end of the connecting cable being connected to the head member, the head member received in the earphone compartment.

2. The electronic device as claimed in claim 1, wherein the recessed portion communicates with the earphone compartment through an L-shaped connecting slot.

* * * * *